US009956569B2

(12) United States Patent
Jimenez Ramos

(10) Patent No.: US 9,956,569 B2
(45) Date of Patent: May 1, 2018

(54) SPRAY COATING APPLICATION SYSTEM

(71) Applicant: Toyota Motor Engineering & Manufacturing North America, Inc., Erlanger, KY (US)

(72) Inventor: Cesar Jimenez Ramos, Tijuana (MX)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 11 days.

(21) Appl. No.: 15/176,698

(22) Filed: Jun. 8, 2016

(65) Prior Publication Data

US 2017/0354985 A1 Dec. 14, 2017

(51) Int. Cl.

| | |
|---|---|
| ***B05B 3/00*** | (2006.01) |
| ***B05C 5/02*** | (2006.01) |
| ***B05B 15/04*** | (2006.01) |

(52) U.S. Cl.

CPC ..... *B05B 15/04* (2013.01); *B05B 3/00* (2013.01); *B05C 5/0216* (2013.01)

(58) Field of Classification Search

None

See application file for complete search history.

(56) References Cited

U.S. PATENT DOCUMENTS

| | | | |
|---|---|---|---|
| 2,733,172 | A | 1/1956 | Brennan |
| 2,900,950 | A | 8/1959 | Peeps |
| 3,036,550 | A | 5/1962 | Remington et al. |
| 3,724,415 | A | 4/1973 | Knight |
| 4,974,532 | A | 12/1990 | March |
| 5,103,761 | A | 4/1992 | Ishibashi et al. |
| 5,175,018 | A | 12/1992 | Lee et al. |
| 6,096,132 | A | 8/2000 | Kaiba et al. |
| 8,455,054 | B2 | 6/2013 | Brewer et al. |
| 2011/0045194 | A1* | 2/2011 | Herre ..... B05B 13/0292 427/421.1 |

OTHER PUBLICATIONS

Esys Automation, "Anti-Chip Applications",Retrieved from the Internet: <http://www.esysautomation.com/paint/anti-chip-applications>, Jun. 8, 2016, 2 pages.

* cited by examiner

*Primary Examiner* — Jethro M Pence

(74) *Attorney, Agent, or Firm* — Christopher G. Darrow; Darrow Mustafa PC

(57) ABSTRACT

A spray coating application system for dispensing a liquid coating includes an elongated guide rail and a longitudinal slide plate slideably attached to the guide rail. The longitudinal slide plate is movable along a longitudinal axis of the guide rail between a first and second longitudinal positions. A transverse slide plate is attached to the longitudinal slide plate for concurrent movement therewith along the longitudinal axis of the guide rail. The transverse slide plate is moveable relative to the longitudinal slide plate in a transverse direction substantially perpendicular to the longitudinal axis of the guide rail. A spray nozzle is attached to the transverse slide plate for dispersing the liquid coating as a spray. A cam follower is attached to the transverse slide plate and engagable with a cam for moving the spray nozzle relative to the longitudinal slide plate between a first transverse position and a second transverse position.

12 Claims, 8 Drawing Sheets

SPRAY COATING APPLICATION SYSTEM

BACKGROUND

Various forms of automated coating systems have been used to apply liquid coatings to a workpiece, such as an automotive vehicle body. The coating systems used to paint automotive vehicles are typically large, complex and expensive. Many systems use industrial paint robots capable of producing uniform film builds and precise coating thicknesses. In order to obtain an optimal and uniform layer of paint and an optimum painting quality, the paint should be sprayed from the painting tool in a controlled manner normal (perpendicular) to the surface to be covered. The motion pattern of the painting tool must then be correspondingly programmed in relation to the curved surfaces and edges of the vehicle body. Although industrial robots can easily adapt the paint tool to the optimal path pattern for the different car models, they are nevertheless complex and costly devices. There is a need for a simpler and less expensive coating apparatus capable of producing an optimal and uniform coating layer.

SUMMARY

Disclosed is an automated spray coating application system that includes a spray coating applicator for applying a liquid coating to a workpiece, such as an automotive vehicle body. The spray coating applicator moves along a guide rail while discharging a stream of liquid coating from a spray nozzle onto the workpiece. To help ensure uniform application of the liquid coating to the workpiece it is desirable that the spray nozzle may be maintained at a generally uniform spacing from the workpiece. This may be accomplished by actively adjusting a position of the spray nozzle relative to the guide rail to accommodate changes in a contour of the workpiece as the spray coating applicator moves lengthwise along the guide rail.

The spray coating applicator includes a slide mechanism attached to a carriage of the guide rail. The slide mechanism includes a longitudinal slide plate that moves in unison with the carriage and a transverse slide plate that moves in a transverse direction independent of the longitudinal slide plate. The spray nozzle is attached to and moves in unison with the transverse slide plate.

The spray coating application system employs a cam system configured to move the transverse slide plate and the spray nozzle transversely relative to the guide rail to maintain a generally uniform spacing between the spray nozzle and the workpiece as the carriage moves the spray coating applicator lengthwise along the guide rail. The cam system includes one or more cams configured to generally mirror a contour of the workpiece. A cam follower travels along the cam as the spray coating applicator moves lengthwise along the guide rail. The cam and cam follower operate in conjunction to move the transverse slide plate relative to the guide rail to accommodate changes in the contour of the workpiece and maintain a generally uniform spacing between the spray nozzle and workpiece.

BRIEF DESCRIPTION OF THE DRAWINGS

The various features, advantages and other uses of the present apparatus will become more apparent by referring to the following detailed description and drawings, in which.

DETAILED DESCRIPTION

Figure 1:
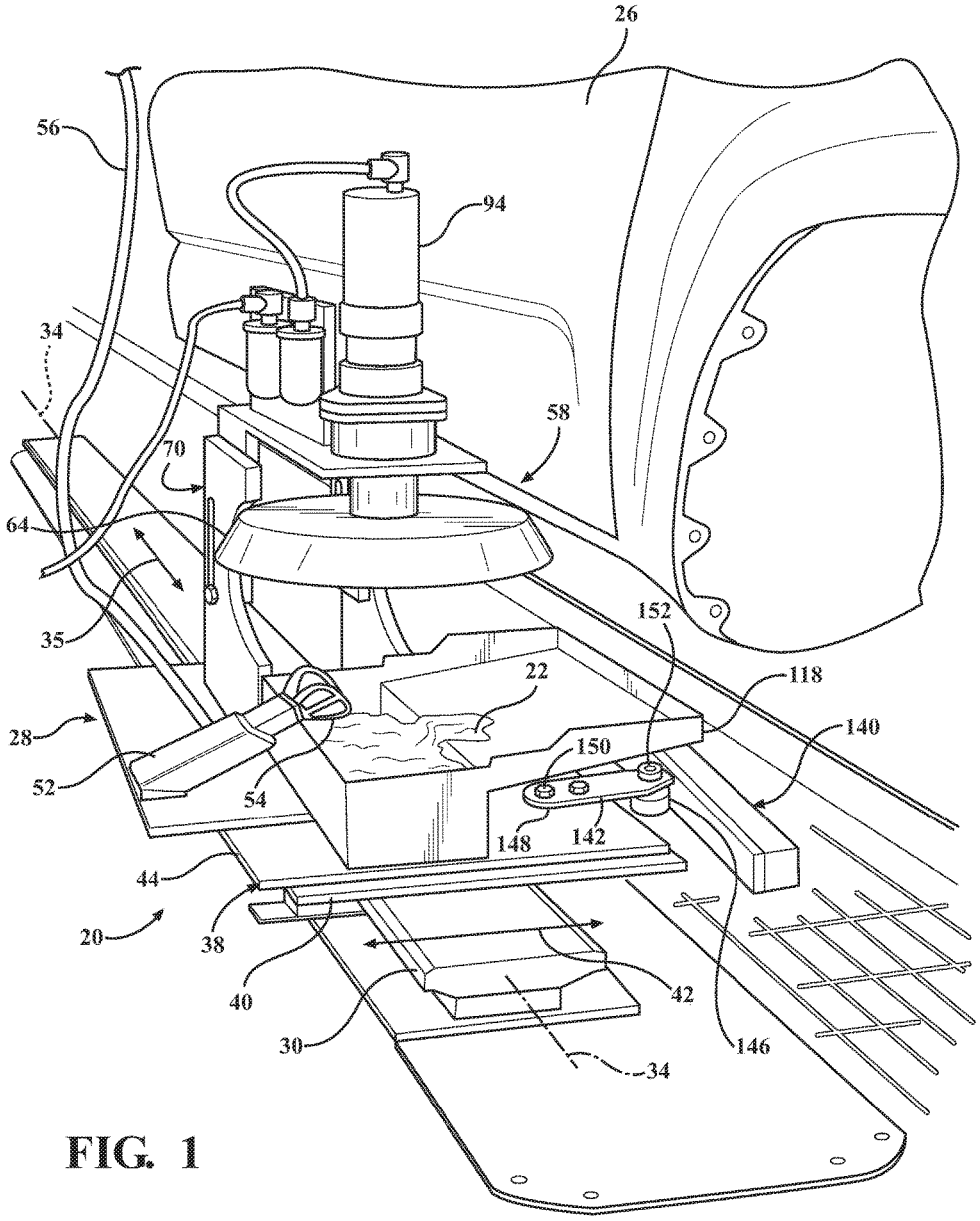
FIG. 1 is a perspective view of an exemplary spray coating application system including a spray coating applicator for dispensing a liquid coating.

A spray coating application system and method of use are disclosed. The spray coating application system may include a spray coating applicator for applying a liquid coating to a workpiece, such as an automotive vehicle body. The spray coating applicator may be moved lengthwise along a linear guide rail while dispensing the liquid coating from a spray nozzle onto the workpiece. To help ensure uniform application of the liquid coating to the workpiece the spray nozzle may be maintained at a generally uniform spacing from the workpiece. This may be accomplished by actively adjusting a position of the spray nozzle relative to the guide rail to accommodate changes in a contour of the workpiece as the spray coating applicator moves lengthwise along the guide rail. The spray coating applicator employs a cam system that moves the spray nozzle transversely relative to the guide rail to maintain the spray nozzle at the desired spacing from the workpiece. The cam system may include one or more cams that can be contoured to generally mirror the contour of the workpiece. A cam follower travels along the cam as the spray coating applicator moves lengthwise along the guide rail to adjust the position of the spray nozzle relative to the guide rail and maintain a generally constant spacing between the spray nozzle and workpiece.

Referring now to the discussion that follows and also to the drawings, illustrative approaches to the disclosed systems and methods are described in detail. Although the drawings represent some possible approaches, the drawings are not necessarily to scale and certain features may be exaggerated, removed, or partially sectioned to better illustrate and explain the present invention. Further, the descriptions set forth herein are not intended to be exhaustive or otherwise limit or restrict the claims to the precise forms and configurations shown in the drawings and disclosed in the following detailed description.

With reference to FIGS. 1-4 and 8, a spray coating application system 20 is operable to apply a liquid coating 22, in the form of a spray 24, onto a workpiece 26. Spray coating application system 20 may include a spray coating applicator 28 moveably attached to an elongated guide rail 30. Spray coating applicator 28 may be repetitively moved along a length of guide rail 30 between a first longitudinal position 29 and a second longitudinal position 31. Guide rail 30 may be suitably attached to a floor 32 of a production facility. A longitudinal axis 34 of guide rail 30 may be oriented generally parallel to workpiece 26. Other orientations may also be employed depending on the requirements of a particular application.

Guide rail 30 may include a drive mechanism that operates to move spray coating applicator 28 in a lengthwise direction 35 along guide rail 30. The drive mechanism may include a linear actuator that repetitively moves spray coating applicator 28 back and forth along guide rail 30. The actuator may include various configurations, including but not limited to, hydraulic, pneumatic, electrical and electromechanical devices, as well as combinations thereof. The linear actuator may be connected to an external carriage 36 that slides lengthwise along guide rail 30. Spray coating applicator 28 may be attached to carriage 36 so as to move spray coating applicator 28 along guide rail 30. A control system may be provided to selectively control operation of the linear actuator and corresponding movement of spray coating applicator 28 along guide rail 30.

With reference to FIGS. 1-4, 7 and 9, spray coating applicator 28 may include a slide mechanism 38 attached to carriage 36 of guide rail 30. Slide mechanism 38 may include a longitudinal slide plate 40 attached to carriage 36. Longitudinal slide plate 40 moves in unison with carriage 36 along guide rail 30. The configuration of guide rail 30 prevents carriage 36 and longitudinal slide plate 40 from moving in a transverse direction 42 relative to guide rail 30. Transverse direction 42 is oriented substantially perpendicular to longitudinal axis 34 of guide rail 30.

Slide mechanism 38 may also include a transverse slide plate 44 moveably attached to longitudinal slide plate 40. Transverse slide plate 44 may be arranged vertically above longitudinal slide plate 40. Transverse slide plate 44 can be moved in unison with longitudinal slide plate 40 and carriage 36 in the lengthwise direction 35, while also being independently moveable relative to longitudinal slide plate 40 and guide rail 30 in the transverse direction 42 between a first transverse position 43 and a second transverse position 45.

A transverse slide mechanism 46 may moveably connect transverse slide plate 44 to longitudinal slide plate 40. Transverse slide mechanism 46 may be located between transverse slide plate 44 and longitudinal slide plate 40. Transverse slide mechanism 46 may be configured to enable transverse slide plate 44 to move in the transverse direction 42 relative to guide rail 30, while substantially preventing transverse slide plate 44 from moving relative to longitudinal slide plate 40 in the lengthwise direction 35.

Transverse slide mechanism 46 may include various configuration that enable transverse slide plate 44 to move in the transverse direction 42 relative to longitudinal slide plate 40 and guide rail 30. Transverse slide mechanism 46 may include, for example, a pair of elongated transverse slide rails 48 that are moveably connected to a set of bearings 50 that may be configured as bearings. Transverse slide rails 48 may be attached to transverse slide plate 44 and bearings 50 may be attached to longitudinal slide plate 40. Alternatively, transverse slide rails 48 may be attached to longitudinal slide plate 40 and bearings 50 may be attached to transverse slide plate 44. Transverse slide rails 48 may each slide within a corresponding set of bearings 50. A longitudinal axis of transverse slide rails 48 may be aligned parallel to the transverse direction 42 and substantially perpendicular to longitudinal axis 34 of guide rail 30. Transverse slide mechanism 46 enables transverse slide plate 44 to be moved in the transverse direction 42 relative to longitudinal slide plate 40 and guide rail 30, while also restricting movement of transverse slide plate 44 relative to longitudinal slide plate 40 in the lengthwise direction 35.

With continued reference to FIGS. 1-4, spray coating applicator 28 may include a sprayer 52 for dispensing liquid coating 22 as spray 24. Sprayer 52 may be attached to transverse slide plate 44. Sprayer 52 and transverse slide plate 44 move in unison in both the transverse direction 42 and lengthwise direction 35.

Sprayer 52 may have various configurations and may include a spray nozzle 54 for generating spray 24. Spray nozzle 54 may be configured to produce a desired spray pattern suitable for the particular application and type of liquid being dispensed. For example, spray nozzle 54 may be configured to produce a generally fan-shaped spray pattern, as well as other spray patterns. Sprayer 52 may be oriented to direct spray 24 discharged from spray nozzle 54 onto workpiece 26. Liquid coating 22 may be supplied to sprayer 52 from a supply source through a liquid coating supply hose 56.

With reference to FIGS. 2-5, spray coating applicator 28 may include a touchless paint masking system 58 capable of producing a smooth spray line 60 (as shown, for example, in FIG. 8) without having to use physical on-vehicle masking. Masking system 58 enables spray coating applicator 28 to produce a consistent film-build to an applied liquid coating edge 62. Masking system 58 may include a rotatable masking disc 64 positioned along a spray path 66 between spray nozzle 54 and workpiece 26. Masking disc 64 operates to block a portion 68 of spray 24 discharged from spray nozzle 54 from reaching workpiece 26 to produce smooth spray line 60.

Masking disc 64 may be rotatably connected to an inverted generally L-shaped masking disc support bracket 70. An end 71 of masking disc support bracket 70 may be attached to transverse slide plate 44 with masking disc 64 attached to an opposite end 73. This arrangement enables masking disc 64 and spray nozzle 54 to move in unison in the transverse direction 42 and in the lengthwise direction 35 (as illustrated, for example, in FIG. 1).

Figure 2:
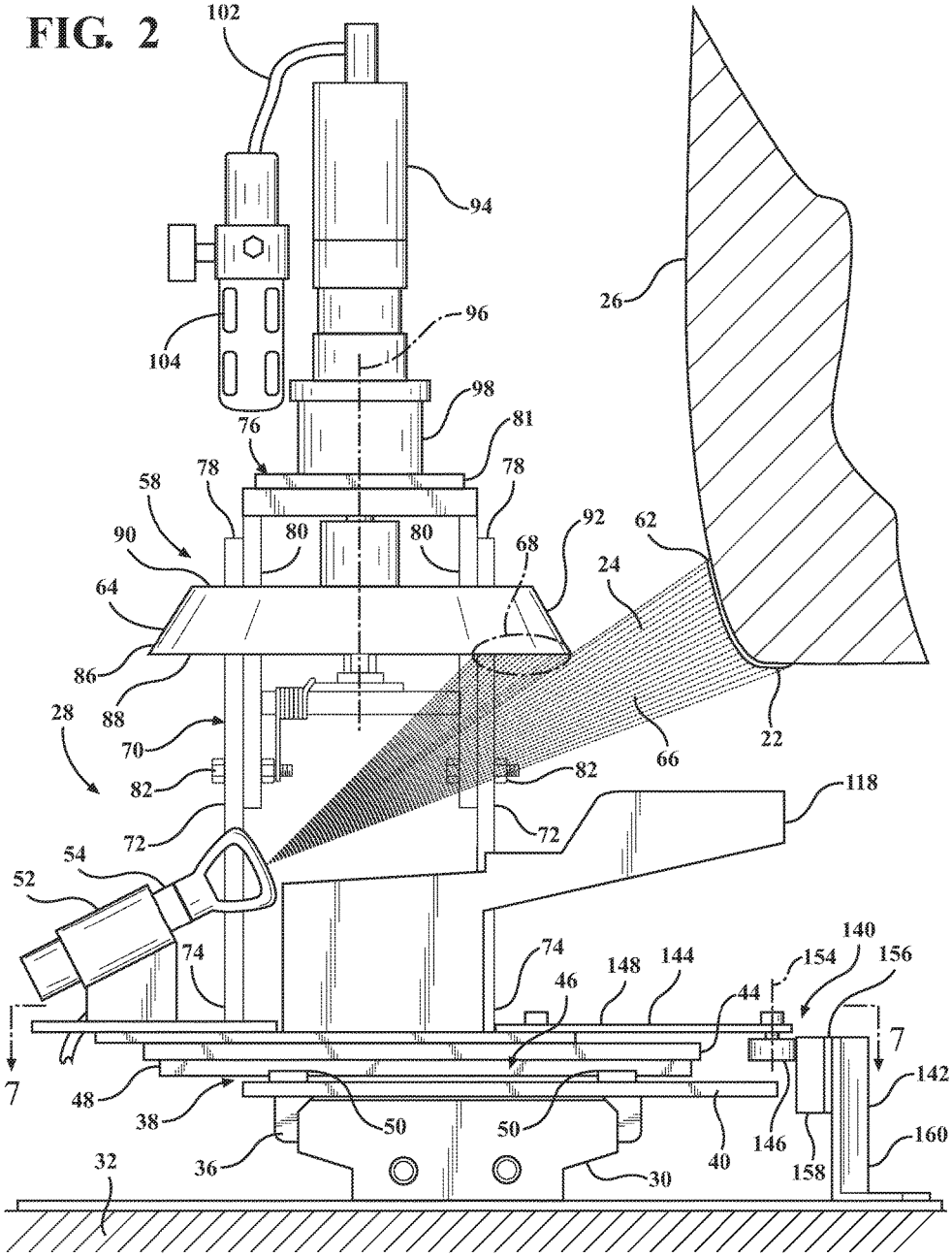
FIG. 2 is a side view of the spray coating applicator illustrating the liquid coating being discharged from a spray nozzle.
Figure 3:
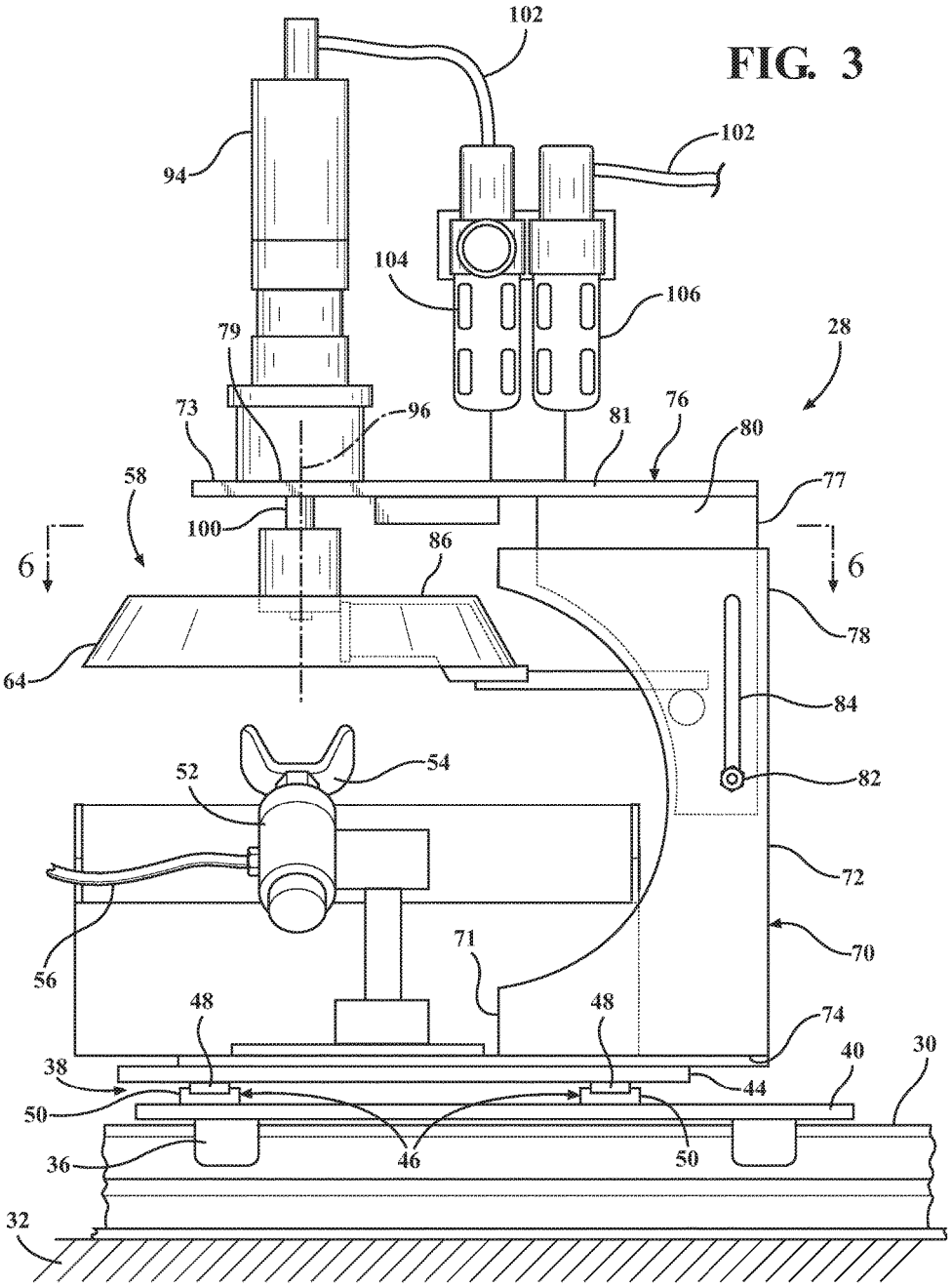
FIG. 3 is a side view of the spray coating applicator viewed from a perspective perpendicular to the view in FIG. 2.
Figure 4:
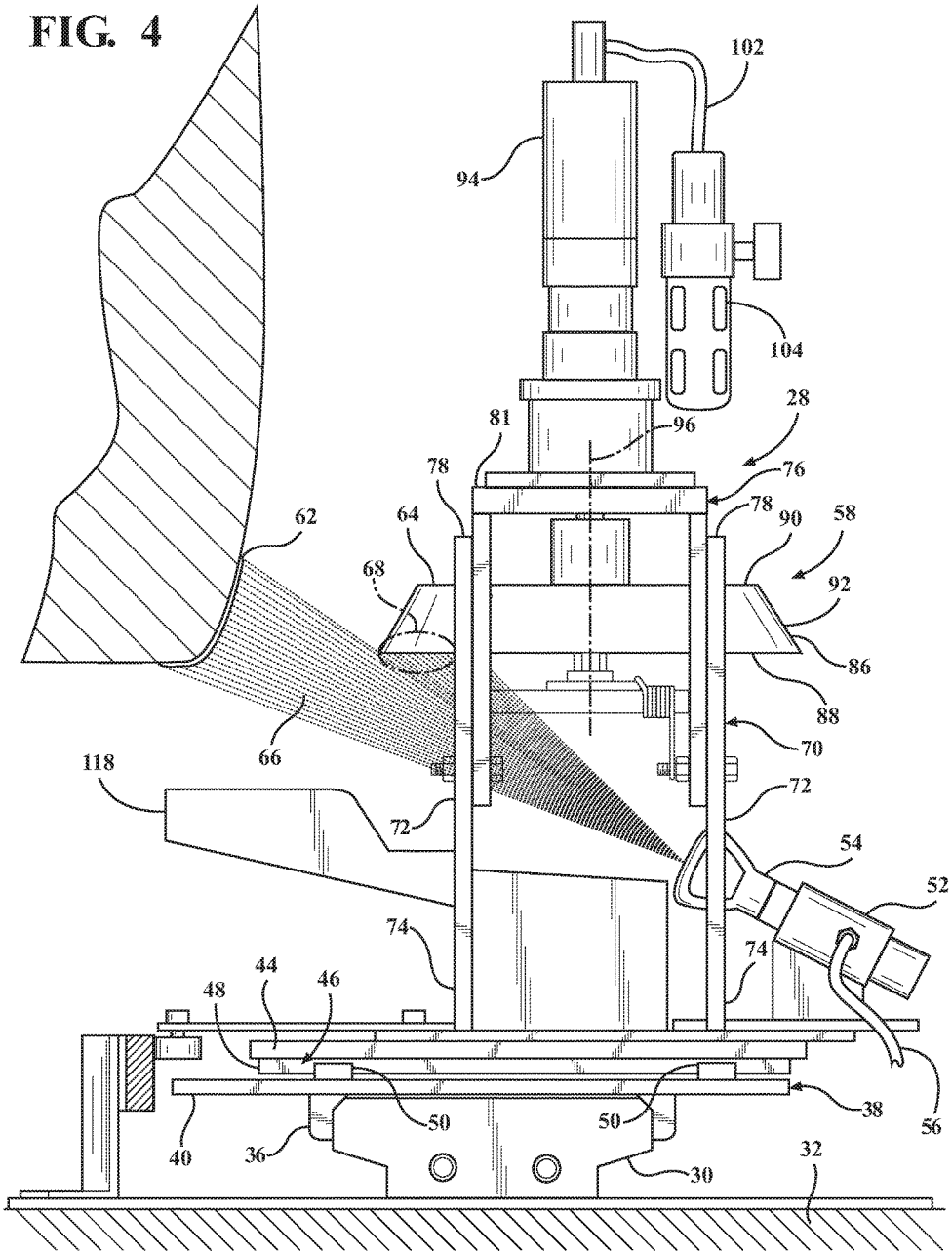
FIG. 4 is a side view of the spray coating applicator viewed from a perspective opposite the view in FIG. 2.

Masking disc support bracket 70 may include a horizontal support member 76 connected to a pair of spaced-apart support legs 72 that extend generally vertically upward from transverse slide plate 44 (as viewed from the perspective of FIGS. 2-4). Support legs 72 may be aligned generally perpendicular to transverse slide plate 44. A proximal end 74 of support legs 72 may be attached to transverse slide plate 44.

Horizontal support member 76 may be cantilevered from support legs 72 to provide clearance between masking disc 64 and support legs 72. A proximal end 77 of horizontal support member 76 may be connected to a distal end 78 of support legs 72 opposite proximal end 74. Masking disc 64 may be rotatably attached to a distal end 79 of horizontal support member 76 opposite proximal end 77.

Horizontal support member 76 may include a pair of mounting tabs 80 that extend generally downward (as viewed from the perspective of FIGS. 2-5) from a masking disc mounting plate 81. Masking disc 64 is may be rotatably attached to masking disc mounting plate 81. Mounting tabs 80 of horizontal support member 76 engage distal ends 78 of support legs 72. A fastener 82 may be used to connect mounting tabs 80 to support legs 72. Fastener 82 may be configured as a releasable type fastener, such as a threaded bolt or screw, to enable horizontal support member 76 to be moved vertically to selectively adjust a position of masking disc 64 relative to spray nozzle 54. Fastener 82 may engage an elongated slot 84 in support legs 72 and an aperture in mounting tabs 80 on horizontal support member 76. Slot 84 enables the position of masking disc 64 to be adjusted vertically relative to spray nozzle 54. The vertical position of masking disc 64 may be selectively adjusted by loosening fastener 82 and sliding horizontal support member 76 vertically to position masking disc 64 at a desired location relative to spray nozzle 54. Masking disc 64 may be retained in the selected vertical position by retightening faster 82 to secure horizontal support member 76 to support legs 72. The range of vertical adjustment of horizontal support member 76 is determined by a length of slot 84.

Figure 5:
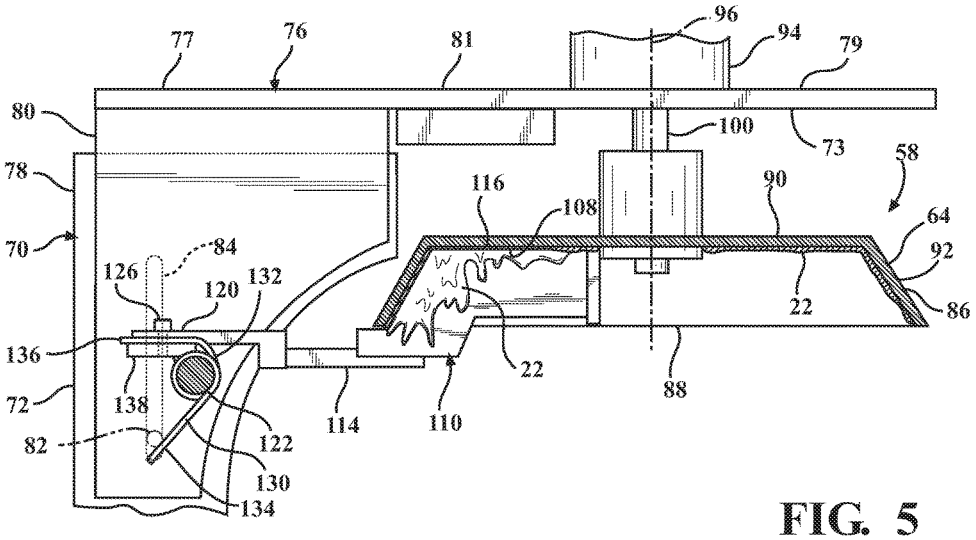
FIG. 5 is a partial cross-sectional view of a masking disk operable for blocking a portion of the liquid coating discharged from the spray nozzle and a wiper for removing accumulated liquid coating from masking disk.
Figure 6:
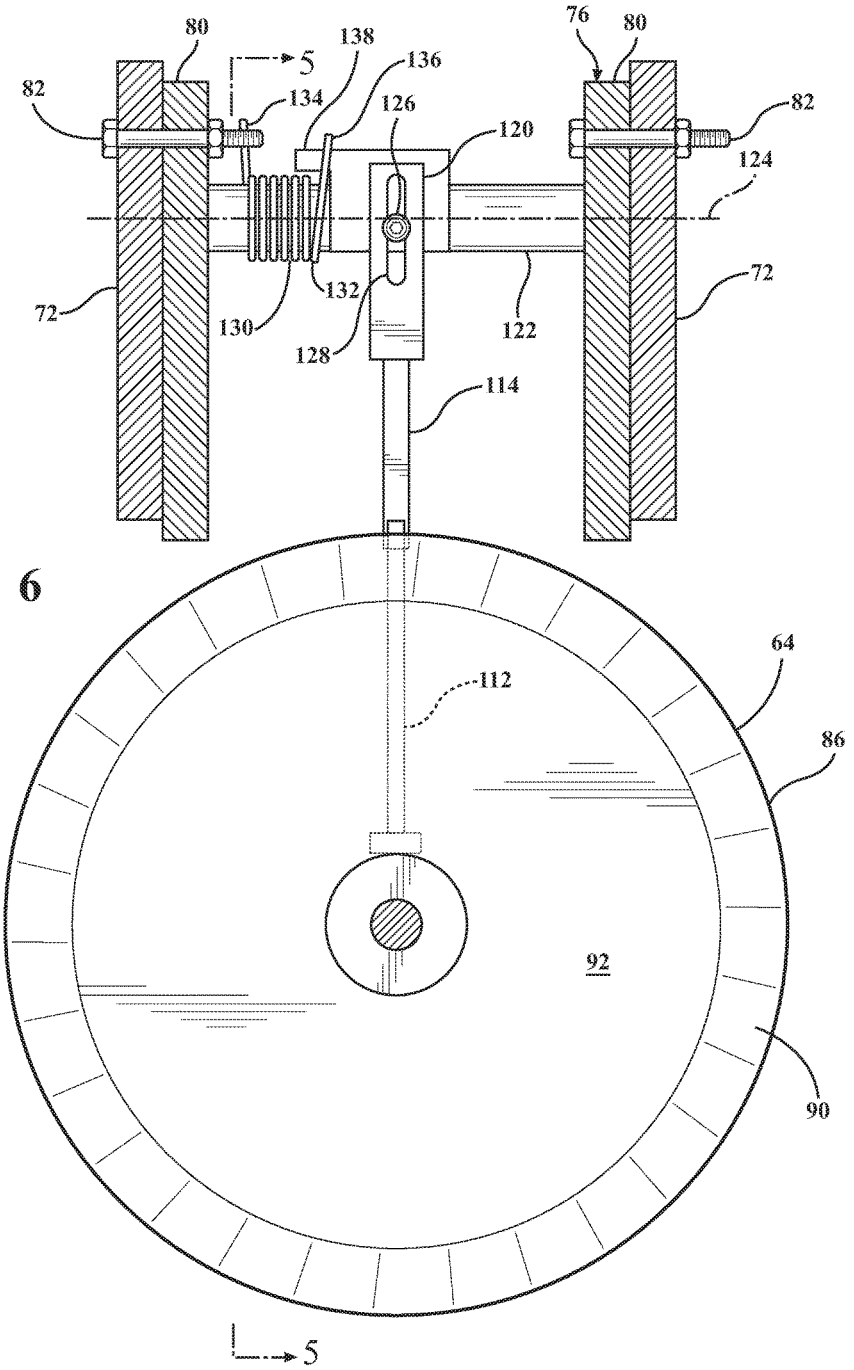
FIG. 6 is a top view of the masking disk and the wiper, which is pivotally connected to a masking disk support bracket.

With reference to FIGS. 5 and 6, masking disc 64 may include an inverted generally bowl-shaped body 86 having an open end 88 and an opposite closed end 90 defined by an end wall. Masking disc 64 may be oriented so that open end 88 faces downward and toward spray nozzle 54. Body 86 may be generally shaped as a truncated cone with a sloping side wall 92 extending between open end 88 and closed end 90. Open end 88 may have a larger diameter than closed end 90, causing body 86 to flare outward from closed end 90 to open end 88. Masking disc 64 may alternatively include a different shape and/or configuration to suit the requirements of a particular application.

With reference to FIGS. 2-5, spray coating applicator 28 may include a motor 94 capable of rotating masking disc 64 about a masking disc axis of rotation 96. An end 98 of motor 94 may be attached to horizontal support member 76. Motor 94 may include a drive shaft 100 that extends outward from end 98 of motor 94 and vertically downward from horizontal support member 76. A longitudinal axis of drive shaft 100 coincides with masking disc axis of rotation 96.

Motor 94 may include a variety of configurations and utilize various power sources, including but not limited to pneumatic, hydraulic and electrical. For example, motor 94 may be configured as a pneumatic motor powered by a stream of pressurized air delivered through a supply hose 102. A pressure regulator 104 may be used to selectively control a pressure level of the air stream delivered to motor 94. A dryer/filter 106 may be used to remove moisture and impurities from the air stream prior to being delivered to motor 94. The pressurized air stream causes drive shaft 100 to rotate masking disc 64 about masking disc axis of rotation 96.

With reference to FIGS. 2 and 4-6, masking disc 64 operates to block portion 68 of spray 24 from reaching workpiece 26. The blocked portion 68 of spray 24 may accumulate as liquid coating 22 on a lower surface 108 of masking disc 64. A wiper 110 may be used to remove the accumulated liquid coating 22 from masking disc 64. Wiper 110 may include a scraper blade 112 attached to a wiper arm 114. An edge 116 of scraper blade 112 may be contoured to match a contour of lower surface 108 of masking disc 64. Scraper blade 112 slides along lower surface 108 as masking disc 64 rotates to remove accumulated liquid coating 22 from masking disc 64. Scraper blade 112 remains stationary while motor 94 rotates masking disc 64. Liquid coating 22 removed from masking disc 64 is pulled by gravity from scraper blade 112 and falls into a collection tray 118 that rests on transverse slide plate 44. Collection tray 118 may be periodically removed from transverse slide plate 44 and emptied of accumulated liquid coating 22. Spray nozzle 54, masking disc 64 and collection tray 118 are all moveable in unison with transverse slide plate 44.

With reference to FIGS. 5 and 6, an end 120 of wiper arm 114 may be attached to a wiper mounting shaft 122 extending between mounting tabs 80. Wiper mounting shaft 122 may pivotally engage apertures in mounting tabs 80 that enable wiper mounting shaft 122 to be rotated about its longitudinal axis 124. A threaded fastener 126 may be used to attach wiper arm 114 to wiper mounting shaft 122. Wiper arm 114 may include a slotted opening 128 for receiving threaded fastener 126, which itself engages a threaded aperture in wiper mounting shaft 122. Slotted opening 128 enables a position of wiper 110 to be adjusted relative to masking disc 64, which may be accomplished by loosening threaded fastener 126 and moving wiper 110 to a selected position. Wiper 110 may be secured to wiper mounting shaft 122 by tightening threaded fastener 126.

A biasing member 130, such as a spring, may be used to maintain contact between scraper blade 112 and masking disc 64. Biasing member 130 generates a counter-clockwise rotational force on wiper 110 (as viewed from a perspective of FIG. 5) to maintain contact between scraper blade 112 and masking disc 64. Biasing member 130 may have various configurations, and may include, for example, a coil spring 132 mounted on wiper mounting shaft 122. A first end 134 of coil spring 132 may engage fastener 82 and a second end 136 may engage a tab 138 on wiper arm 114. Biasing member 130 may alternatively include a different configuration.

With reference to FIGS. 1, 2 and 7-9, spray coating application system 20 may include a cam system 140 that operates to actively adjust a position of spray nozzle 54 relative to guide rail 30 when moving spray coating applicator 28 lengthwise along guide rail 30. Cam system 140 may include a cam 142 and a cam follower 144 that tracks along cam 142. Cam follower 144 may be attached to transverse slide plate 44, which moves in unison with cam follower 144 in the transverse direction 42.

Cam follower 144 may include a generally cylindrically-shaped roller 146 rotatably connected to a cam follower mounting bracket 148. Cam follower mounting bracket 148 may be attached to transverse slide plate 44 using fasteners 150 that engage apertures in cam follower mounting bracket 148 and attach to transverse slide plate 44. Various types of fasteners may be used, including but not limited to, screws, bolts and rivets. The apertures in cam follower mounting bracket 148 may be configured as elongated slots to enable positioning of cam follower 14 on transverse slide plate 44. In applications where the ability to adjust the position of cam follower 144 is not necessary or desirable, cam follower 144 may alternatively be connected to transverse slide plate 44 using various other permanent or semi-permanent attachment mechanisms, such as, for example, welding, brazing and adhesives.

Cam follower 144 may include a roller 146 attached to an end of cam follower mounting bracket 148 opposite fasteners 150. Roller 146 may be attached to cam follower mounting bracket 148 using a bolt 152 or another type of fastener. Roller 146 may be configured to rotate about a roller axis of rotation 154 as roller 146 tracks along cam 142.

Cam follower 144 may alternatively include a different configuration. For example, cam follower 144 may be configured to slide rather than roll along cam 142. Various coatings and/or lubricants may be applied to one of both of cam follower 144 and cam 142 to reduce frictional drag as cam follower 144 slides along cam 142.

Figure 7:
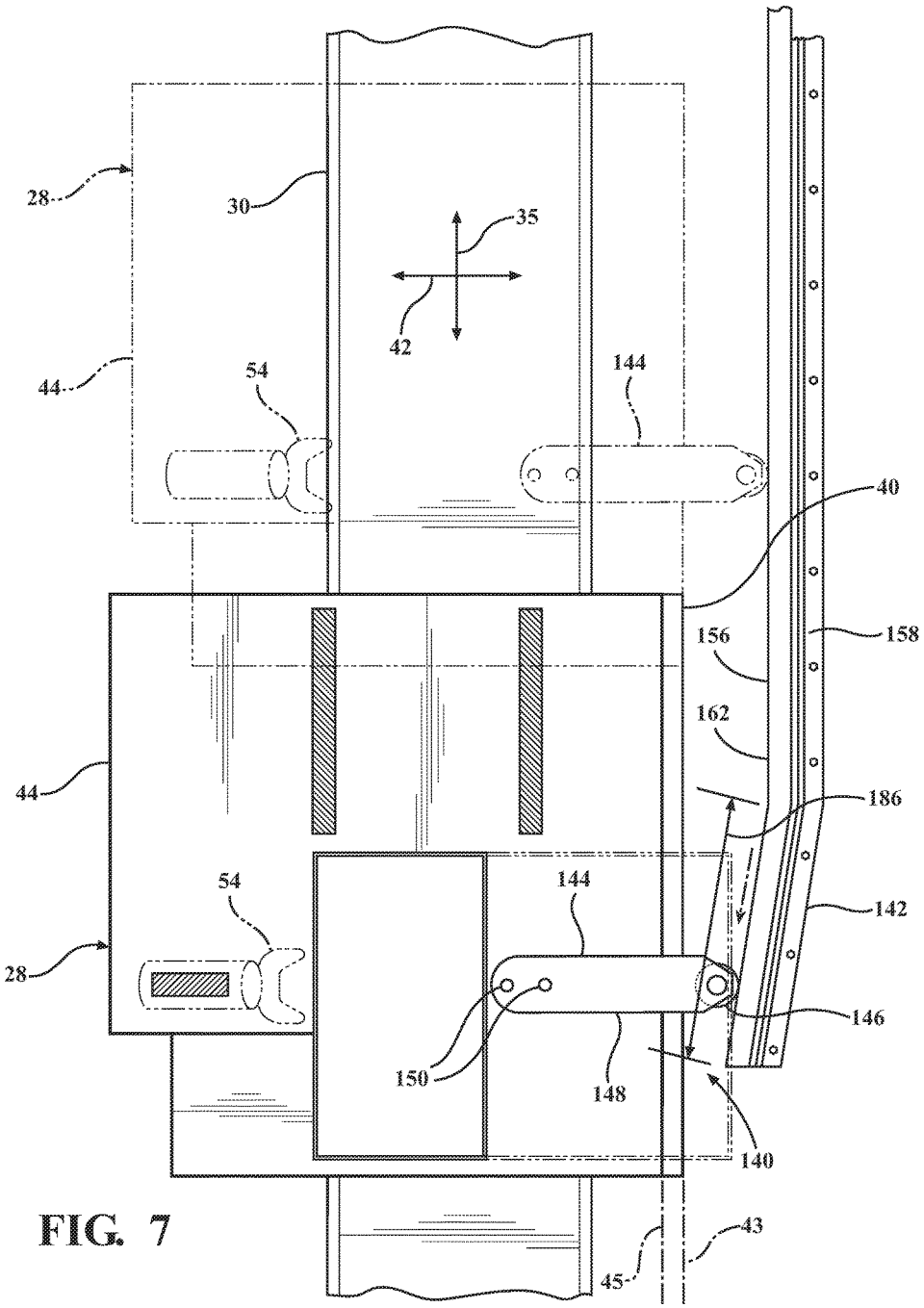
FIG. 7 is a partial cross-sectional view of the spray coating applicator taken along section line 7-7 of FIG. 2, illustrating a cam system operable for moving a transverse slide plate between a first transverse position and a second transverse position.

With reference to FIGS. 2 and 7, cam 142 may include various configurations depending in part on the design requirements of a particular application. For example, cam 142 may include an elongated cam plate 156 attached to a support member 158. One or more cam mounting brackets 160 may be attached to support member 158. Cam mounting bracket 160 may be used to secure cam 142 to a stationary feature, such as floor 32 of the production facility, guide rail 30, or another object that remains substantially stationary relative to guide rail 30. Cam 142 may be aligned generally parallel to longitudinal axis 34 of guide rail 30. Cam follower 144 may be moved along a cam surface 162 of cam plate 156 when spray coating applicator 28 is moved along guide rail 30. Cam surface 162 may be contoured to cause transverse slide plate 44, and correspondingly spray nozzle 54, to move in a predetermined manner in the transverse direction between first transverse position 43 and a second transverse position 45 to accommodate changes in the contour of workpiece 26 and maintain a generally consistent spacing between spray nozzle 54 and workpiece 26.

Cam 142 may extend the entire length of guide rail 30 or only a portion of its length. Cam 142 may include a single cam or multiple cams arranged generally end-to-end or spaced apart. It is not necessary that cam surface 162 of each cam 142 in a multiple cam configuration be similarly configured, as one or more of the cam surfaces 162 may have a similar or different contour than any of the other cam surfaces.

Figure 9:
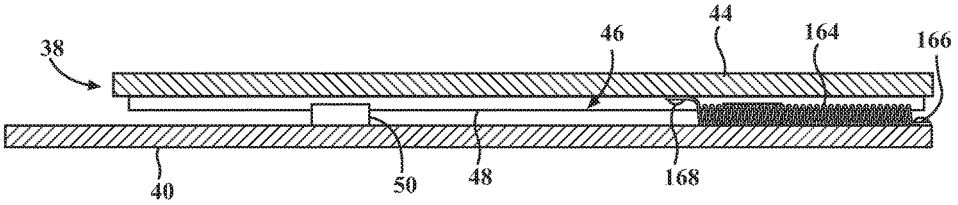
FIG. 9 is a partial cross-sectional view of a slide mechanism of the spray coating applicator illustrating a biasing mechanism operably for urging the transverse slide toward the first transverse position.

With reference to FIG. 9, slide mechanism 38 may include a biasing member 164 having a first end 166 attached longitudinal slide plate 40 and an opposite second end 168 attached to transverse slide plate 44. Biasing member 164 generates a biasing force used to maintain contact between cam follower 144 and cam 142. The location at which second end 168 of biasing member 164 is attached to transverse slide plate 44 is spaced further from cam follower 144 than the location at which first end 166 of biasing member 164 is attached to longitudinal slide plate 40. Biasing member 164 may have any of various configurations. In the illustrated example, biasing member 164 is configured as a coil spring, but other differently configured biasing mechanisms may also be employed.

Figure 8:
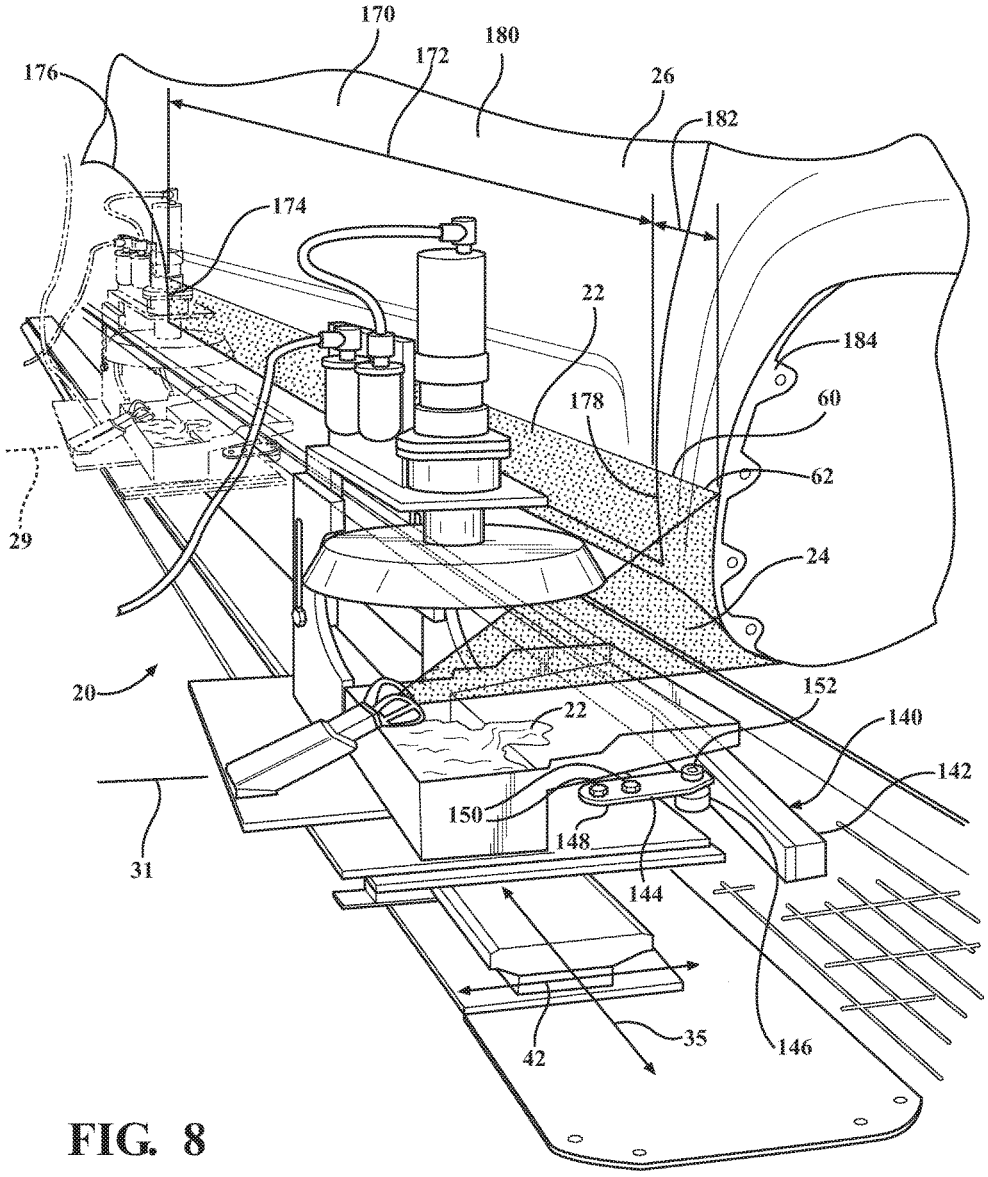
FIG. 8 is a perspective view of the spray coating application system illustrating movement of the spray coating applicator between a first longitudinal position and a second longitudinal position.

A spray application process in which spray coating application system 20 applies a layer of liquid coating 22 to workpiece 26 is described with reference to FIGS. 7 and 8. In the illustrated example, workpiece 26 is configured as an automotive vehicle body 170. Vehicle body 170 may include a relatively flat longitudinal region 172 with minimal contour change laterally. Longitudinal region 172 may extend from a front edge 174 of a rear wheel opening 176 to a leading edge 178 of a front door 180. Vehicle body 170 may also include a flared region 182 that extends from leading edge 178 of front door 180 to a front wheel opening 184. Flared region 182 extends outward and toward guide rail 30, thereby reducing a spacing between guide rail 30 and vehicle body 170 in the vicinity of flared region 182. Spray coating application system 20 may also be used to apply liquid coating 22 to differently configured vehicle bodies as well as other types of workpieces, and is not limited to automotive components.

Spray coating application system 20 operates to move spray coating applicator 28 along guide rail 30 from first longitudinal position 29 to second longitudinal position 31 while discharging a stream of liquid coating 22 from spray nozzle 54 in the form of spray 24. FIG. 8 illustrates spray coating applicator 28 positioned in first longitudinal position 29 (spray coating applicator 28 depicted in phantom) and second longitudinal position 31 (spray coating applicator 28 depicted in solid line). Spray coating applicator 28 may be selectively moved from first longitudinal position 29 to second longitudinal position 31 while applying a layer of liquid coating 22 to vehicle body 170. Spray coating applicator 28 may initially be positioned in first longitudinal position 29. Liquid coating may be sprayed onto workpiece 26 while moving spray coating applicator 28 from first longitudinal position 29 toward second longitudinal position 31. As spray coating applicator 28 approaches flared region 182 of vehicle body 170, cam follower 144 begins traveling along an inclined region 186 of cam 142. Inclined region 186 may be configured to generally mirror the contour of flared region 182. As cam follower 144 travels along inclined region 186 of cam 142, transverse slide plate 44, to which spray nozzle 54 is attached, is moved in the transverse direction 42 relative to longitudinal slide plate 40 and guide rail 30. This movement enables spray nozzle 54 to be maintained at a generally uniform spacing from vehicle body 170 as spray coating applicator 28 passes over longitudinal region 172 and flared region 182 of vehicle body 170. Returning spray coating applicator to first longitudinal position 29 causes cam follower 144 to track back along inclined region 185 of cam 142 and enables biasing member 164 to move transverse slide plate 44 back to its original position relative to guide rail 30 and longitudinal slide plate 40.

It is intended that the scope of the present methods and apparatuses be defined by the following claims. However, it must be understood that the disclosed systems and methods may be practiced otherwise than is specifically explained and illustrated without departing from its spirit or scope. It should be understood by those skilled in the art that various alternatives to the configurations described herein may be employed in practicing the claims without departing from the spirit and scope as defined in the following claims. The scope of the disclosed systems and methods should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. Furthermore, all terms used in the claims are intended to be given their broadest reasonable constructions and their ordinary meanings as understood by those skilled in the art unless an explicit indication to the contrary is made herein. In particular, use of the singular articles such as "a," "the," "said," etc., should be read to recite one or more of the indicated elements unless a claim recites an explicit limitation to the contrary. It is intended that the following claims define the scope of the device and that the method and apparatus within the scope of these claims and their equivalents be covered thereby. In sum, it should be understood that the device is capable of modification and variation and is limited only by the following claims.

What is claimed is:

1. A spray coating application system for dispensing a liquid coating, the system comprising:

a slide comprising a transverse slide plate movably attached to a longitudinal slide plate;

a spray nozzle for dispersing the liquid coating, the spray nozzle fixed for concurrent movement with the transverse slide plate;

a cam follower fixedly attached to the transverse slide plate for concurrent movement therewith, the cam follower including one of a roller or a slide; and a cam engagable with the cam follower for moving the transverse slide plate relative to the longitudinal slide plate between a first transverse position and a second transverse position, the cam including a cam surface contoured to accommodate changes in a contour of a workpiece, the cam follower being configured to roll or slide along the cam surface, whereby a substantially consistent spacing between the spray nozzle and the workpiece is maintained.

2. The spray coating application system of claim 1, wherein the slide is moveably attached to an elongated guide rail, the slide moveable along a longitudinal axis of the guide rail between a first longitudinal position and a second longitudinal position.

3. The spray coating application system of claim 2, wherein the transverse slide plate is fixed for concurrent movement with the longitudinal slide plate along the longitudinal axis of the guide rail, the transverse slide plate moveable relative to the longitudinal slide plate in a transverse direction substantially perpendicular to the longitudinal axis of the guide rail.

4. The spray coating application system of claim 3, wherein the longitudinal slide plate is moveable along the longitudinal axis of the guide rail and is fixedly attached to the guide rail in the transverse direction.

5. The spray coating application system of claim 1 further comprising a masking disk operable for blocking a portion of the liquid coating dispensed from the spray nozzle, the masking disk attached to the transverse slide plate for concurrent movement therewith, the spray nozzle located vertically between the transverse slide plate and the masking disk.

6. The spray coating application system of claim 5 further comprising a wiper slideably engaging the masking disk.

7. The spray coating application system of claim 6 further comprising a masking disk support bracket connecting the masking disk and the wiper to the transverse slide plate for concurrent movement therewith.

8. The spray coating application system of claim 7, wherein the wiper is pivotally attached to the masking disk support bracket.

9. The spray coating application system of claim 5, wherein the masking disk is rotatable about a masking disk axis of rotation.

10. The spray coating application system of claim 5 further comprising a spray coating collection tray removably mounted to the transverse slide plate for concurrent movement therewith, the spray nozzle located vertically between the spray coating collection tray and the masking disk.

11. The spray coating application system of claim 1 further comprising an elongated transverse slide rail connecting the transverse slide plate to the longitudinal slide plate.

12. The spray coating application system of claim 1 further comprising a biasing member connecting the transverse slide plate to the longitudinal slide plate, the biasing member operable for urging the transverse slide plate toward the first transverse position and away from the second transverse position.

* * * * *